US005358840A

United States Patent [19]

Chaffee et al.

[11] Patent Number: 5,358,840

[45] Date of Patent: Oct. 25, 1994

[54] TABULAR GRAIN SILVER IODOBROMIDE EMULSION OF IMPROVED SENSITIVITY AND PROCESS FOR ITS PREPARATION

[75] Inventors: Eleanor Chaffee, Webster; Mamie Kam-Ng, Fairport; Allen K. Tsaur, Fairport; David E. Fenton, Fairport; Donald L. Black, Webster, all of N.Y.

[73] Assignee: Eastman Kodak Company, Rochester, N.Y.

[21] Appl. No.: 96,104

[22] Filed: Jul. 22, 1993

[51] Int. Cl.[5] ..... G03C 1/035; G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,665,012 | 5/1987 | Sugimoto et al. | 430/502 |
| 4,797,354 | 1/1989 | Saitou et al. | 430/567 |
| 4,883,748 | 11/1989 | Hayakawa | 430/567 |
| 4,945,037 | 7/1990 | Saitou | 430/567 |
| 4,962,015 | 10/1990 | Aida et al. | 430/572 |
| 5,096,806 | 3/1992 | Nakamura et al. | 430/569 |
| 5,210,013 | 5/1993 | Tsaur et al. | 430/567 |

*Primary Examiner*—Charles L. Bowers, Jr.
*Assistant Examiner*—Mark F. Huff
*Attorney, Agent, or Firm*—Carl O. Thomas

[57] ABSTRACT

Silver iodobromide tabular grain emulsions of enhanced photographic sensitivity are disclosed. The silver iodobromide grains contain from 2 to less than 10 mole percent iodide, exhibit a coefficient of variation of less than 20 percent, and consisting essentially of tabular grains having opposed parallel major faces. Each of the tabular silver bromoiodide grains exhibit an iodide concentration in excess of 6 mole percent within a surface region extending to a depth of less than 0.02 μm and exhibit a central iodide concentration of less than 2 mole percent.

The tabular grain emulsion is prepared by providing within a reaction vessel a population of silver bromide or iodobromide host grains exhibiting a coefficient of variation of less than 20 percent and containing less than 2 mole percent iodide consisting essentially of tabular grains and introducing silver, bromide and iodide ions into the reaction vessel for deposition onto the major faces on the host tabular grains, with iodide ions accounting for at least 25 mole percent of total halide ions introduced.

13 Claims, 3 Drawing Sheets

TABULAR GRAIN SILVER IODOBROMIDE EMULSION OF IMPROVED SENSITIVITY AND PROCESS FOR ITS PREPARATION

FIELD OF THE INVENTION

The invention relates to photographic emulsions and to processes for their preparation.

BACKGROUND

In referring to silver halide grain structures and emulsions containing two or more halides the halides are named starting with the halide present in the lowest concentration and ending with the halide present in the highest concentration.

Emulsions containing grains formed of silver combined with chloride, bromide, iodide or any possible mixture of these halides are known to form latent images upon exposure to visible or near ultraviolet radiation and can be employed for photographic purposes. The photographically least used silver halide grain compositions are high iodide (>90 mole percent iodide, based on silver) silver halides. The iodide ion released during development inhibits further development and, unless addressed in developer formulation, can effectively arrest grain development. Although the remaining silver halide compositions have application specific advantages, the most widely employed photographic emulsions are silver iodobromides, since they exhibit the highest attainable levels of photographic sensitivity and exhibit superior speed-granularity relationships. The incorporation of iodide ions into the face centered cubic silver bromide crystal lattice of the grains has been demonstrated to enhance the efficiency of latent image formation. Silver iodobromide emulsions are almost universally used for camera speed photography.

Kofron et al U.S. Pat. 4,439,520, Wilgus et al U.S. Pat. 4,434,226 and Solberg et al U.S. Pat. 4,433,048 were the first to point out the photographic advantages of tabular grain silver iodobromide emulsions. Among numerous advantages resulting from the tabular shape of the grains were improvements in photographic sensitivity and speed-granularity relationships. As clearly shown in FIG. 1 of Wilgus et al and FIG. 3 of Kofron et al, the iodobromide tabular grain emulsions contained a variety of grain shapes and exhibited considerable variance among the tabular grains. The tabular grain emulsions were not monodisperse, regardless of whether the entire grain population or only the tabular grain population is considered in assessing grain dispersity.

Tsaur et al U.S. Pat. No. 5,210,013 discloses the preparation of highly monodisperse tabular grain silver bromide and iodobromide emulsions. Tabular grain emulsions are disclosed exhibiting a coefficient of variation (hereinafter also referred to as COV) of less than 10 percent based on the total grain population. The tabular grain emulsions of Tsaur et al exhibit a higher level of monodispersity than previously realized in preparing tabular grain emulsions. In comparative Example 14 Tsaur et al remade the most monodisperse of the emulsions reported by Saitou et al U.S. Pat. No. 4,797,354 to demonstrate that the total grain dispersity (COV) of the emulsions of Saitou et al are in excess of 30 percent.

It is realized by those skilled in the art that the iodide content of silver iodobromoide grains can be uniformly distributed or varied. A variety of iodide placements in tabular grain emulsions are known. The varied forms of iodide placement are illustrated by Solberg et al, cited above; Sugimoto et al U.S. Pat. No. 4,665,012; Hayakawa et al U.S. Pat. No. 4,883,748; Saitou U.S. Pat. No. 4,945,037 and Aida et al U.S. Pat. No. 4,962,015.

Tsaur et al, cited above, in Examples 3 and 4 prepares silver iodobromide tabular grain emulsions by a procedure in which iodide concentrations are increased following the formation of host tabular silver bromide grains.

SUMMARY OF THE INVENTION

The present invention has as its purpose to improve the photographic sensitivity of silver iodobromide tabular grain emulsions.

This is achieved by recognizing for the first time that the combination of low levels of overall emulsion grain dispersity, a limited range of overall iodide concentrations, and specifically chosen iodide placements within silver iodobromide tabular grains produces sharply increased levels of photographic sensitivity.

In one aspect the invention is directed to a process of preparing a silver iodobromide tabular grain emulsion of enhanced photographic sensitivity comprised of the steps of (a) providing within a reaction vessel a population of silver bromide or iodobromide host grains exhibiting a coefficient of variation of less than 20 percent and containing less than 2 mole percent iodide, the host grains consisting essentially of tabular grains, (b) introducing silver, bromide and iodide ions into the reaction vessel for deposition onto the major faces on the host tabular grains, with iodide ions accounting for at least 25 mole percent of total halide ions introduced, and (c) limiting the overall iodide content of the emulsion to from 2 to less than 10 mole percent, based on total silver.

In another aspect the invention is directed to a silver iodobromoide emulsion of enhanced photographic sensitivity comprised of a dispersing medium and silver iodobromide grains wherein the silver iodobromide grains contain from 2 to less than 10 mole percent iodide based on total silver, exhibit a coefficient of variation of less than 20 percent, and consist essentially of tabular grains having opposed parallel major faces and each of the tabular silver iodobromide grains within a central projected area extending half the distance to its peripheral edge (a) exhibit an iodide concentration in excess of 6 mole percent within a surface region extending to a depth of less than 0.02 μm and (b) exhibit an iodide concentration of less than 2 mole percent measured in a thickness bisecting plane oriented parallel to the opposed major faces.

DESCRIPTION OF PREFERRED EMBODIMENTS

Figure 1:
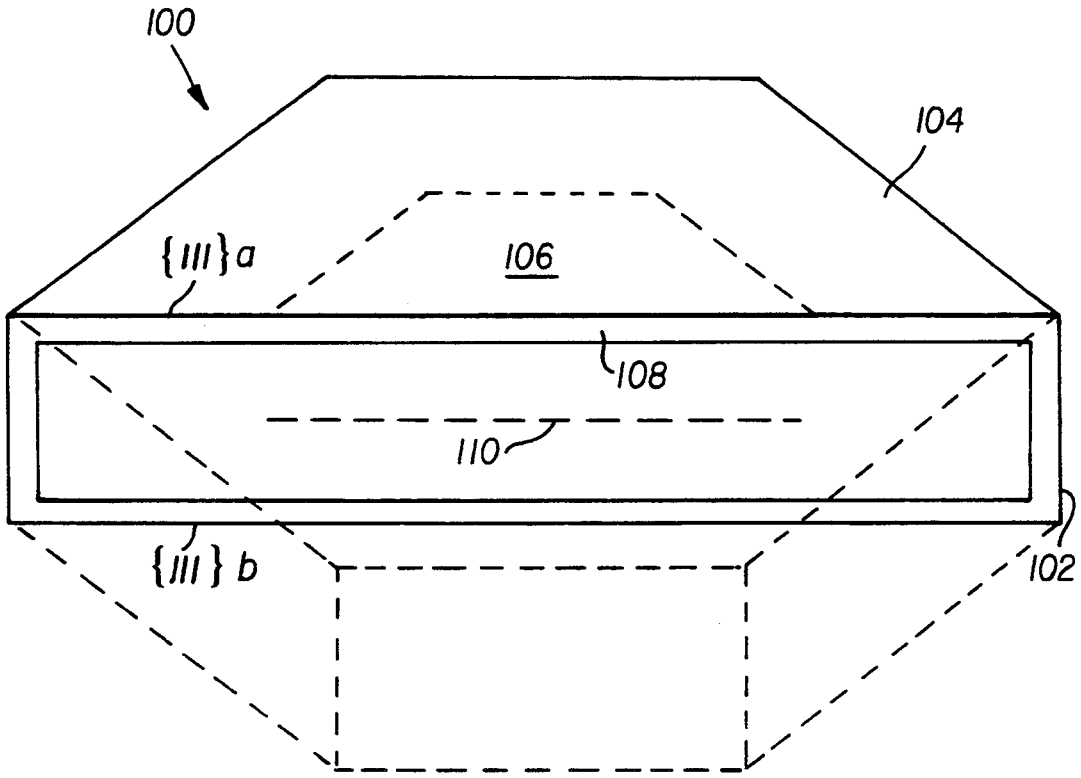
FIG. 1 is a schematic sectional view of a tabular grain satisfying the requirements of the invention.

In FIG. 1 is shown a schematic sectional view of an ideal silver iodobromide tabular grain structure contemplated for the practice of the invention. One half of tabular grain 100 has been removed by sectioning to allow both the exterior and the interior of the grain to be seen. The location and outline of the tabular grain half removed by sectioning is shown in phantom by dashed lines. The tabular grain is bounded by opposed parallel major faces {111}*a* and {111}*b* and a peripheral edge 102 that has been schematically simplified, since the edge structure of the grains can take any convenient conventional form.

As shown the tabular grain 100 has a regular hexagonal projected area 104 defined by the peripheral edge 102. Within the projected area 104 is located a central projected area 106 that extends half the distance to the peripheral edge. The purpose for defining the central projected area is to provide a readily identifiable area for iodide profile measurements that are not influenced by the edges of the grain.

As shown in the section plane the exterior of the tabular grain is formed by a surface region 108 that extends to a depth of less than 0.02 μm from the grain surface. The surface region within the central projected area exhibits an iodide content in excess of 6 mole percent. A central region of the tabular grain within the central projected area has a lower iodide content than the surface region. To allow iodide measurements to be referenced to a specific central location a bisecting plane 110 is shown in FIG. 1. The bisecting plane is oriented parallel to the opposed parallel major faces of the tabular grain. The plane is designated a bisecting plane, since exactly half of the tabular grain thickness lies above the plane and exactly half of the tabular grain thickness lies below the plane. Within the central projected area of the tabular grain the iodide concentration of the portion of the tabular grain located at the bisecting plane is less than 2 mole percent. That is, it is less than one third the iodide concentration measured in the surface region.

The iodide profile of a tabular grain between its major faces (that is, across its thickness) can be determined by analytical procedures well known to those skilled in the art. A preferred analytical procedure is analytical electron microscopy (AEM). Using this procedure for determining the iodide profile across a tabular grain thickness a slice is cut from a tabular grain using a microtome. A sectional surface of the tabular grain slice is then addressed at measured steps to determine the iodide level at each step location. When an electron beam impinges on the sectional surface at a selected point a fluorescent emission is stimulated. Each of bromide and iodide fluoresce with a different spectral emission profile. By comparison with fluorescent spectral profiles generated by known compositions, it is possible to determine the amount of both iodide and bromide ion present at the addressed point. The analytical technique employed is described by J. I. Goldstein, "Introduction to Analytical Electron Microscopy", *Plenum*, N.Y. (1983) and by G. Cliff and G. W. Lorimer, *J. Microscopy*, 103:203 (1975). Solberg et al, cited above, provides an illustration of this technique applied to identifying iodide concentrations in silver iodobromide tabular grains, except that Solberg et al was concerned only with determining iodide variations across the faces of tabular grains rather than across their thicknesses and hence did not slice the grains to provide a sectional surface for examination.

The realization of high levels of photographic sensitivity not only requires the presence of silver iodobromide tabular grains satisfying the iodide profile defined above, but additionally requires that the total silver iodobromide grain population be highly monodispersed. In quantitative terms it is contemplated that the total silver iodobromide grain population of the emulsion in all instances exhibit a COV of less than 20 percent, preferably less than 15 percent, and optimally less than 10 percent. These very stringent COV requirements preclude the use of emulsions that are merely nominally tabular—i.e., tabular silver iodobromide grains accounting for greater than 50 percent of total grain projected area. In the emulsions of the invention the silver iodobromide grains must consist essentially of (that is, almost exclusively) of tabular grains to satisfy these stringent COV requirements.

To produce a silver iodobromide tabular grain emulsion satisfying both the iodide profile and dispersity requirements of the invention a novel precipitation procedure has been devised. According to this procedure a population of silver bromide or iodobromide host tabular grains exhibiting a coefficient of variation of less than 20 percent (preferably less than 15 percent and optimally less than 10 percent) and containing less than 2 mole percent iodide, based on silver, is provided. The preferred procedure for providing the host tabular grain population is to employ any of the low COV emulsion precipitation procedures of Tsaur et al U.S. Pat. Nos. 5,147,771, 5,147,772, 5,147,773, 5,210,013 and 5,171,659, the disclosures of which are here incorporated by reference. These procedures have been demonstrated to be effective in producing both silver bromide emulsions and silver iodobromide emulsions having iodide contents of less than 2 mole percent. It is preferred to provide host tabular grains having an iodide content of less than 1 mole percent, since in the preferred form of the invention the iodide content of the tabular grains of the invention is less than 1 mole percent measured along the bisecting plane. Silver bromide host tabular grains are ideally suited for the practice of the invention.

Silver iodobromide is next deposited onto the host tabular grains. This is preferably accomplished by introducing silver, bromide and iodide ions into a reaction vessel containing the host tabular grains for deposition onto their major faces. Iodide ions account for at least 25 mole percent of the total halide ions introduced. A convenient introduction approach is to add to the reaction vessel a soluble silver salt, such as silver nitrate as an aqueous solution through one jet while adding an aqueous mixture of water soluble bromide and iodide salts, such as alkali or ammonium halides, through a second jet. Alternatively, each halide can be concurrently added through a separate jet. Another approach is to add to the reaction vessel a silver iodobromide Lippmann emulsion containing the desired ratio of bromide to iodide ions. Ostwald ripening of the Lippmann emulsion grains will result in deposition of the silver, bromide and iodide ions onto the major faces of the host tabular grains.

During the step of introducing the silver, iodide and bromide ions the pBr within the reaction vessel can be equal to or higher than that required foe tabular grain formation. That is, the pBr can range down to 0.6. In the pBr range of from 0.6 to 2.2 the majority of deposition occurs at the edges of the tabular grains, increasing their diameter, while the desired deposition onto the major faces of the tabular grains constitutes only a fraction of total deposition. It is therefore preferred to maintain the pBr during this step at or above 2.2. At higher pBr levels deposition is shifted away from the tabular grain edges so that the major portion of deposition occurs on the major faces of the host tabular grains. The pBr level within the reaction vessel can range up to the equivalence point—that is, up to the point at which there is a stoichiometric balance of silver and halide ions in solution. Since deposition above the equivalence point runs the risk of objectionably increasing emulsion fog, it is preferred to limit the pBr during deposition to less than 9.5 (most preferably less than 8.0 and optimally less than 6.5).

The iodide ion concentration as a percent of total halide introduced during the silver, iodide and bromide ion introduction step is in all instances greater than 25 mole percent and can range upwardly to any level compatible with obtaining a single phase silver iodobromide surface region on the host tabular grains. It is generally recognized that under common precipitation conditions the saturation level of iodide ions in a face centered cubic silver bromide crystal lattice is approximately 40 mole percent, based on silver. If the proportion of iodide ion in the halide salt solution or solutions exceeds 40 mole percent, it does not follow that a separate high iodide phase will be formed on the major faces on the host tabular grains in addition to the silver iodobromide phase sought to be deposited. Instantaneous lowering of the iodide ion concentration occurs when the halide salt solution or solutions are introduced into the reaction vessel. Further, even if a limited amount of a high iodide silver halide phase forms on the major faces of the host tabular grains, absent persistent iodide ion supersaturation levels, the high iodide phase is a transient phase that disappears as iodide ion is integrated into the silver iodobromide phase by recrystallization as precipitation progresses. Nevertheless, it is preferred to maintain the proportion of iodide ion introduced at less than 40 mole percent of the total halide concurrently introduced to eliminate any risk of forming a separate high iodide silver halide phase and thereby complicating even transiently the tabular grain structure.

Limiting the overall (i.e., total) iodide concentration of the tabular silver iodobromide grains within the range of from 2 to less than 10 mole percent, preferably from 3 to 7 mole percent, based on total silver, can be accomplished by routine adjustments of the amount of silver and iodide ions introduced during each step of the process.

It is generally most convenient to rely on the host tabular grains described above to provide at least 50 percent and preferably at least 60 mole percent of the total silver ions present in the completed emulsion. The step of introducing greater than 25 mole percent iodide ions, based on total concurrently introduced halide ions, described above, is preferably limited to introducing from 5 to 30 (optimally from 10 to 25) percent of the total silver forming the emulsion grains.

Based on the much lower solubility of silver iodode as compared to silver bromide it is believed that substantially all of the iodide ions introduced during deposition onto the host tabular grains are precipitated. Nevertheless, the greater than 25 mole percent iodide ion concentrations used in precipitation produce much lower iodide ion concentrations within the surface regions of the tabular grains. That is, no iodide ion concentration levels have been found within the surface region of the grains that even approach 25 mole percent iodide. Typically surface region iodide concentrations are less than 10 mole percent, based on silver. One possible explanation is that iodide ion migrates into earlier precipitated crystal lattices as precipitation is occurring. This effect is also commonly referred to as recrystallization.

While it is essential to achieving high levels of photographic sensitivity that the iodide ion concentration in the surface region of the grain be greater than 6 mole percent, it is believed to be advantageous to keep the maximum iodide ion concentrations just beneath the surface of the tabular grains. This has been attempted by following the step of concurrently introducing silver, bromide and iodide ions with the introduction of only silver and bromide ions. Another approach is to add only additional silver ions to the reaction vessel, relying on the bromide ions in solution to supply the bromide ions required for further silver bromide precipitation.

In this optional step, hereinafter referred to as the iodide ion free overrun step, up to 30 preferably less than 25) percent of the total silver forming the completed tabular grains can be introduced. To assure that a continuous surface layer is deposited it is preferred that the iodide ion free overrun step provide at least 5 (optimally at least 10) percent of the total silver forming the tabular grains.

It would be expected that employing an iodide ion free overrun step would result in producing at the surface of the tabular grains a lower iodide concentration than in the remainder of the surface region. However, analytical observations of iodide profiles have not identified any lower iodide ion concentration at the tabular grain major faces than elsewhere within the surface region. A possible explanation is that iodide ion already deposited to form the surface region is migrating into the crystal lattice newly deposited during the iodide ion free overrun step. In other words, iodide redistributing recrystallization is taking place. Thus, the observed effect of the iodide ion free overrun step is not to produce a reduced iodide ion surface concentration, but simply to lower slightly the iodide concentration within the entire surface region. This in turn indicates that the desired iodide ion concentration can be realized during the surface region deposition step without employing an iodide ion free overrun step. In other words, the iodide ion free overrun step is not essential, and its iodide ion concentration moderating effect can be accomplished during the step of depositing iodide ions onto the host tabular grains.

The tabular grain constructions described above are generally applicable to all conventional tabular grain aspect ratios and tabularities and to all tabular grain thicknesses. For convenience of preparation, it is generally preferred that the tabular grains have an average thickness of at least 0.06 μm. The invention has been demonstrated employing thin (less than 0.2 μm) tabular grains, and it is apparent that the invention is entirely suitable for tabular grain thicknesses ranging up to 0.3 μm or higher. Tabular grain emulsions with average aspect ratios ranging from 2 up to 100 are more are contemplated. Intermediate and higher (greater than 5) average aspect ratios are preferred and high (greater than 8) average aspect ratios are generally optimum for obtaining the highest levels of photographic sensitivity. Preferred tabular grain emulsions satisfying the requirements of this invention exhibit average tabularities of greater than 25, tabularity being defined by the relationship:

$$ECD \div t^2$$

where

ECD is mean tabular grain equivalent circular diameter and t is mean tabular grain thickness, each being measured in micrometers.

Except for the features explicitly discussed, the tabular grain silver iodobromide emulsions of this invention as well as their preparation and photographic use will be readily apparent to those skilled in the art. For example, conventional details of silver iodobromide tabular grain technology are disclosed by the following, the disclosures of which are here incorporated by reference:

ICBR-1: Wilgus et al U.S. Pat. No. 4,434,345;
ICBR-2: Kofron et al U.S. Pat. No. 4,439,520;
ICBR-3: Solberg et al U.S. Pat. No. 4,433,048;
ICBR-4: Maskasky U.S. Pat. No. 4,435,501;
ICBR-5: Maskasky U.S. Pat. No. 4,713,320;
ICBR-6: Saitou et al U.S. Pat. No. 4,797,354;
ICBR-7: Daubendiek et al U.S. Pat. No. 4,914,014;
ICBR-8: Tsaur et al U.S. Pat. Nos. 5,147,771-3;
ICBR-9: Tsaur et al U.S. Pat. No. 5,171,659; and
ICBR-10: Tsaur et al U.S. Pat. No. 5,210,013.

EXAMPLES

The invention can be better appreciated by reference to the following specific embodiments:

Emulsion E-1 (ECX399)

Into a 4 liter reaction vessel was placed an aqueous gelatin solution having a pAg of 9.38 composed of 1 L of water, 0.25 g of alkali processed gelatin, 3.5 mL of 4N nitric acid solution, 1.12 g of sodium bromide and 7.68 percent by weight, based on total silver used in nucleation, of Pluronic L43 TM, a polyalkylene oxide surfactant satisfying Formula IV of Tsaur et al U.S. Pat. No. 5,210,013 (x=19, y=6, y'=6). While maintaining a temperature of 45° C. 5.67 mL of an aqueous solution of silver nitrate (containing 0.24 g of silver nitrate) and 5.67 mL of an aqueous solution of sodium bromide (containing 0.15 g of sodium bromide) were simultaneously added to the reaction vessel over a period of 1 minute at a constant rate. The mixture was stirred for 1 minute during which 85 mL of an aqueous sodium bromide solution (containing 8.75 g of sodium bromide) was added at the 50 second point of the hold. Thereafter, following 1 minute of mixing, the temperature within the reaction vessel was raised to 60° C. over a period of 9 minutes. Then 16.7 mL of an aqueous solution of ammonium sulfate (containing 1.68 g of ammonium sulfate) were added, and the pH of the mixture was adjusted to 9.5 with aqueous sodium hydroxide (1N). The mixture was stirred for 9 minutes. Then 83 mL of an aqueous gelatin solution (containing 16.7 g of alkali processed gelatin) were added, and the mixture was stirred for 1 minute, followed by a pH adjustment to 5.85 using aqueous nitric acid (1N). The mixture was stirred for 1 minute. Thereafter, 30 mL of aqueous silver nitrate (containing 1.27 g of silver nitrate) and 32 mL of aqueous sodium bromide (containing 0.66 g of sodium bromide) were added simultaneously over a 15 minute period. Then 49 mL of aqueous silver nitrate (containing 13.3 g of silver nitrate) and 48.2 mL of aqueous sodium bromide (containing 8.68 g of sodium bromide) were added simultaneously at a constant rate of acceleration starting from respective rates of 1.67 mL/min and 1.70 mL/min for the subsequent 82.4 minutes. A 1 minute hold while stirring followed.

Thereafter 80 mL of an aqueous silver nitrate solution (containing 32.6 g of silver nitrate) and 69.6 mL of an aqueous halide solution (containing 11.6 g of sodium bromide and 10.4 g of potassium iodide) were added simultaneously over a 9.6 minute period at a constant rate. Then 141 mL of an aqueous silver nitrate solution (containing 57.5 g of silver nitrate of 147.6 mL of an aqueous sodium bromide solution (containing 38.0 g of sodium bromide) were added simultaneously over a 16.9 minute period at a constant rate.

Grain shape and dispersity features are summarized in Table IA. The average equivalent circular diameter (ECD) of the emulsion grains was 2.87 μm while the average thickness of the emulsion grains was 0.123 μm. The average aspect ratio (ECD ÷ t) of the emulsion was 23 while the average tabularity ($ECD \div t^2$) of the emulsion grains was 190. The average coefficient of variation (COV) of the emulsion grains was 12.5 percent.

Significant iodide parameters are summarized in Table IB. The overall average iodide content of the grains (ΣI) was 3.44 mole percent (M%), based on total silver. The iodide concentration of the halide salt solution run into the reaction vessel (Iconc.) was 32.5 mole percent. The duration of the iodide run addition as a percentage of total silver addition (I Run % ΣRun) was 10 percent with iodide addition occurring during the interval during which silver addition to the reaction vessel was being increased from 71 to 81 percent of total silver added (I Run vs. %Ag).

Emulsion E-2 (ECX423)
Emulsion E-3 (ECX408)
Emulsion E-4 (ECX390)
Emulsion E-5 (ECX429)
Emulsion E-6 (ECS421)

These emulsions illustrate parameter variations of Emulsion E-1 prepared by generally similar procedures. Significant parameters are summarized in Tables IA and IB. Note particularly the reduction of the run iodide concentration of Emulsion E-6.

Emulsion C-1 (ECX410)

The procedure used to prepare this emulsion was identical to that used to prepare Emulsion E-1, except that the aqueous halide solution was replaced with 29.6 mL of a solution containing 13.6 g of sodium bromide and 6.7 grams of potassium iodide. This reduced the concentration percentage of run iodide. Significant parameters are summarized in Tables IA and IB.

Emulsion C-2 (ECX391)
Emulsion C-3 (ECX388)

These emulsions illustrate parameter variations of Emulsion C-1 prepared by the same procedure, but with further reductions in run iodide concentrations. Significant parameters are summarized in Tables IA and IB.

Each of the emulsions identified above and listed in Tables IA and IB were optimally sulfur and gold sensitized and green sensitized employing anhydro-9-ethyl-3,3'-di(sulfopropyl)-4,5,4',5'-dibenzothiacarbocyanine hydroxide, triethylammonium salt. A magenta dye-forming coupler dispersion was blended in a 1:1 weight ratio with each emulsion, and each resulting incorporated coupler emulsion was coated on a transparent photographic film support at a coverage of 10.76 mg/dm$^2$.

A sample of each coating was exposed by a tungsten light source through graduated density test object and a Wratten 9 TM filter, which permits significant transmission at wavelengths beyond 480 nm. This exposure was used to determine green speed (Speed in Table IB). A separate sample off each coating was also exposed through a graduated density test object to a 365 nm light source to determine its native sensitivity, hereinafter referred to as 365-line speed. Processing was conducted using the Eastman Color Negative TM processing chemicals and procedures. Speed was measured at a density of 0.12 above minimum density. Emulsion E-1 was assigned a relative speed of 100, and each unit of difference in reported relative speeds is equal to 0.01 log E, where represents exposure in lux-seconds.

TABLE IA

| Emul. | ECD (μm) | t (μm) | ECD t | ECD $t^2$ | COV (%) |
|---|---|---|---|---|---|
| E-1 | 2.87 | 0.123 | 23 | 190 | 12.6 |
| E-2 | 3.04 | 0.135 | 22 | 165 | 13.0 |
| E-3 | 2.87 | 0.123 | 24 | 188 | 11.5 |
| E-4 | 2.82 | 0.123 | 23 | 190 | 11.8 |
| E-5 | 2.51 | 0.142 | 18 | 125 | 10.7 |
| E-6 | 2.73 | 0.105 | 26 | 246 | 12.5 |
| C-1 | 2.83 | 0.120 | 24 | 197 | 12.3 |
| C-2 | 2.89 | 0.118 | 24 | 206 | 11.5 |
| C-3 | 2.94 | 0.124 | 24 | 191 | 12.0 |
| C-4 | 2.99 | 0.080 | 37 | 464 | 25.0 |
| C-5 | 2.87 | 0.083 | 35 | 416 | 29.3 |
| C-6 | 3.15 | 0.076 | 41 | 545 | 25.4 |

TABLE IB

| Emul. | ΣI (M %) | I conc. (M %) | I Run % ΣRun | I Run vs. % Ag | Speed |
|---|---|---|---|---|---|
| E-1 | 3.44 | 32.5 | 10 | 71–81 | 100 |
| E-2 | 3.95 | 35.8 | 10 | 70–79 | 103 |
| E-3 | 3.50 | 32.6 | 10 | 68–78 | 102 |
| E-4 | 4.06 | 30.6 | 13 | 73–86 | 97 |
| E-5 | 3.62 | 32.8 | 11 | 64–75 | 99 |
| E-6 | 2.96 | 26.8 | 10 | 70–80 | 81 |
| C-1 | 2.30 | 20.8 | 10 | 70–80 | 69 |
| C-2 | 1.33 | 19.6 | 7 | 73–80 | 64 |
| C-3 | 1.44 | 10.9 | 13 | 73–86 | 61 |
| C-4 | 3.60 | 33 | 10 | 71–81 | 61 |
| C-5 | 2.80 | 25.5 | 11 | 70–81 | 53 |
| C-6 | 2.10 | 19.2 | 11 | 70–81 | 49 |

At a minimum there is nearly a one half stop (0.15 log E) speed advantage for the slowest speed emulsion satisfying the requirements of the invention as compared to the highest speed control emulsion, the maximum speed advantage between an example emulsion and a control emulsion is 0.41 log E. Since each 0.30 log E represents a doubling of speed, it is apparent that the speeds of the emulsions of the invention are on average roughly twice those of the control emulsions.

Figure 2:
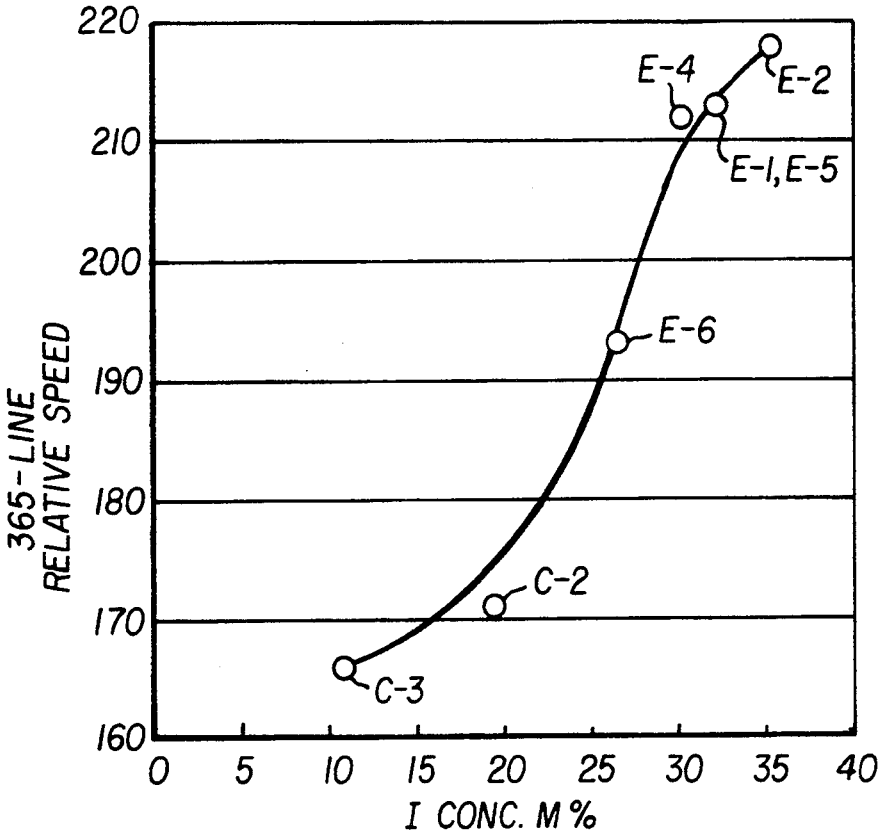
FIG. 2 is a plot of the iodide ion concentration introduced during precipitation in mole percent of total halide, based on silver, versus relative speed for 365 nm emission line exposure.
Figure 3:
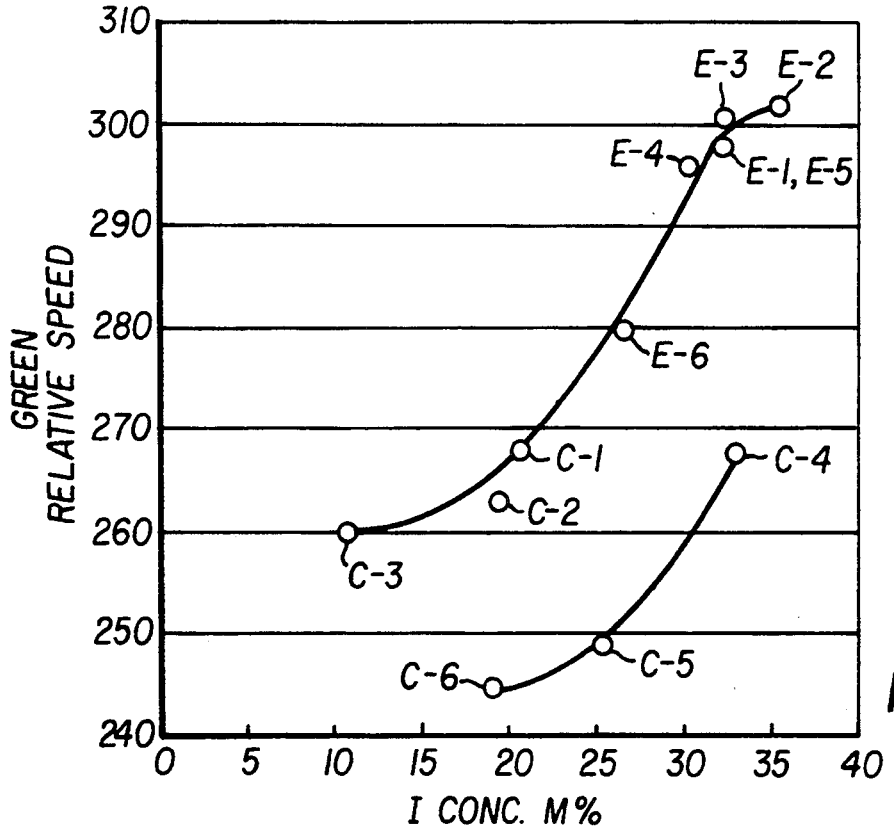
FIG. 3 is a plot of the iodide ion concentration introduced during precipitation in mole percent of total halide, based on silver, versus relative green speed.

By referring to Table IB the importance of maintaining an iodide concentration of at least 25 mole percent of total halide while forming the surface region of the grain. FIG. 2 is a plot of 365-line speed versus iodide concentration as a percent of total halide (I conc. M%), each ascending tier marker on the speed scale represents a speed increase of 0.10 log E. FIG. 3 is a similar plot of green speed as reported above.

Figure 4:
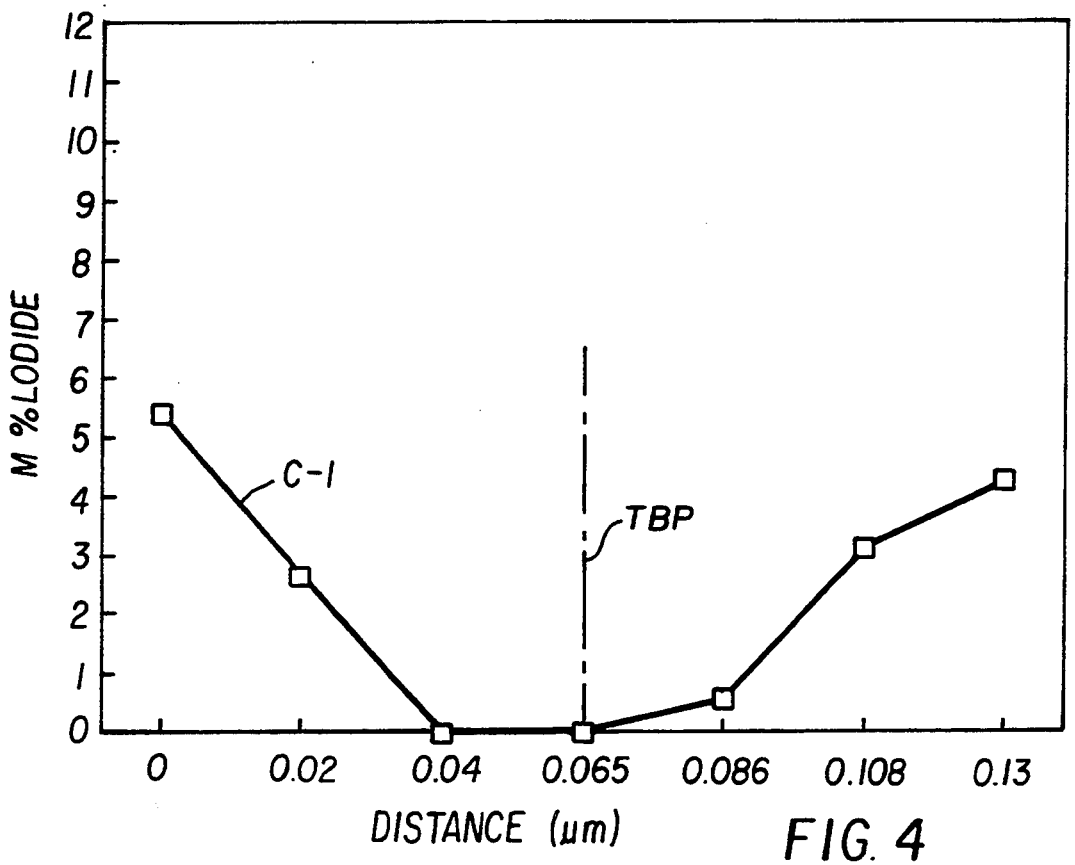
FIG. 4 is a plot of iodide ion concentration in mole percent versus tabular grain thickness for a grain of a control emulsion.
Figure 5:
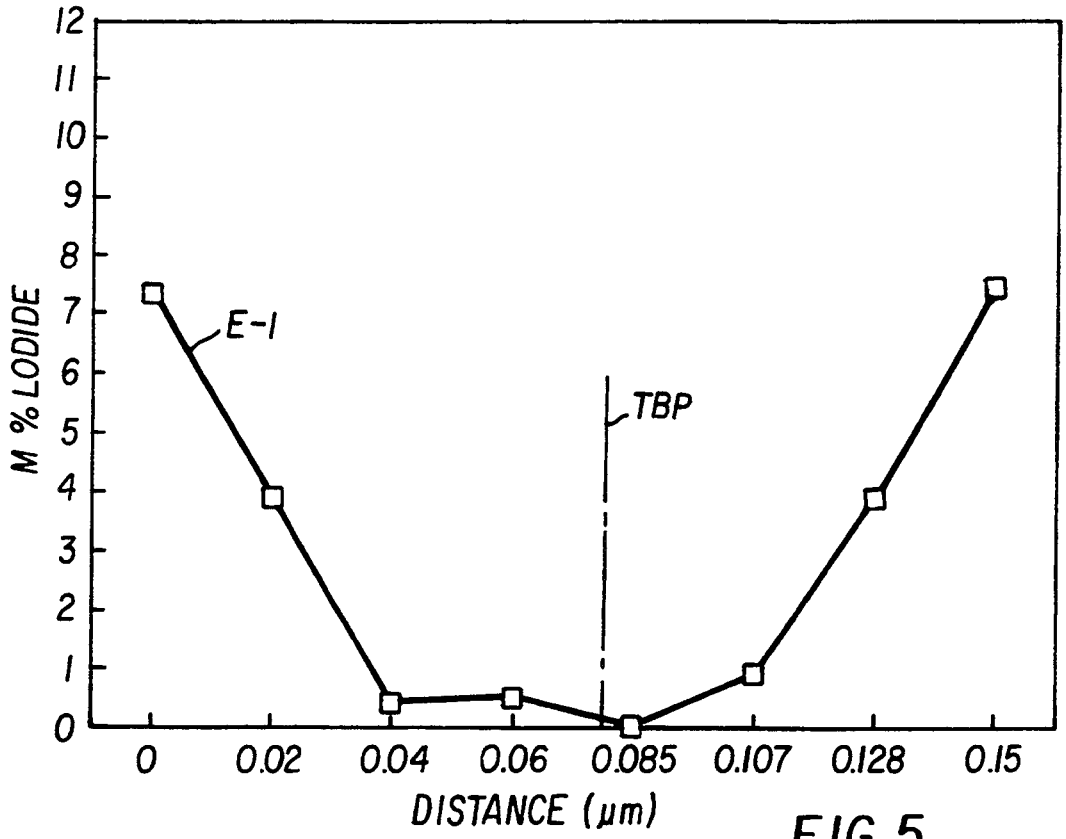
FIG. 5 is a plot of iodide ion concentration in mole percent versus tabular grain thickness for a grain of an example emulsion.

The higher speed of the example emulsions, which correlate with higher iodide ion concentrations during tabular grain precipitation, also correlate with higher iodide ion concentrations in the surface region of the tabular grain. In FIG. 4 an iodide ion concentration thickness profile of a typical tabular grain from Emulsion C-1 obtained by analytical electron microscopy (AEM) is shown. Note that although the iodide ion concentration in the grain increases in moving from the thickness bisecting plane (TBP) to the major faces of the tabular grain, the highest iodide concentrations in the grain remain less than 6 mole percent. In FIG. 5 the corresponding iodide ion concentration profile of a typical tabular grain taken from Emulsion E-1 is shown. Note that within 0.02 μm of both major faces of the tabular grain iodide ion concentrations exceed 6 mole percent. At the thickness bisecting plane (TBP), the iodide ion concentration is well below 2 mole percent, based on total silver.

Emulsion C-4 (ECX465)

This emulsion was prepared to determine the effect on photographic speed of increasing dispersity, specifically of increasing COV above 20%.

The emulsion preparation procedure used to prepared Emulsion E-1 was varied in the following respects:

a) Pluronic L43 TM (0.012 g/L) was replaced with a conventional antifoammant (NALCO 3241 TM) (0.33 g/L);
b) The grain nucleation rate was tripled; and
c) The reaction vessel temperature during grain growth was reduced from 60° C. to 50° C.

The significant parameters of the grain and its preparation are provided above in Tables IA and IB.

Emulsion C-5 (ECX469)

Emulsion C-6 (ECX466)

These emulsions were prepared similarly as Emulsion C-4, except that the run iodide concentrations were reduced, as shown FIG. 3.

Emulsions C-4, C-5 and C-6 each exhibited a COV of between 25 and 30 percent. The emulsions were sensitized, blended with coupler, coated, exposed to green light and processed identically as the remaining emulsions shown in FIG. 3.

When the performance of the more polydisperse emulsions C-4, C-5 and C-6 is compared in FIG. 3 with the performance of the more monodisperse emulsions discussed above, it is apparent that employing a run iodide concentration of 25 mole percent and higher, resulting in surface region iodide concentrations in excess of 6 mole percent does not alone produce the high speed levels exhibited by the emulsions of the invention. Rather, it is clear that the high levels of sensitivity exhibited by the emulsions of the invention depend both on high run iodide concentrations satisfying the requirements described above and low grain dispersity levels, reflected in COV's of less than 20 percent.

Emulsion C-7 (AKT1153)

This comparative emulsion was prepared to demonstrate the effect of introducing iodide ions to provide an overall iodide concentration, 3.5 mole percent, based on silver, similar to that of the example emulsions, but with the iodide introduced to provide an essentially flat iodide profile. That is, iodide ion introduction was begun after grain nucleation and remained at substantially the same concentration through the remainder of the run.

Into a 4 liter reaction vessel was placed an aqueous gelatin solution having a pAg of 9.71 composed of 1 L of water, 0.5 g of alkali processed gelatin, 3.9 mL of 4N nitric acid solution, 2.44 g of sodium bromide and 5.83 percent by weight, based on total silver used in nucleation, of Pluronic L43 TM. While maintaining a temperature of 45° C. 1.0 mL of an aqueous solution of silver nitrate (containing 0.17 g of silver nitrate) and 0.93 mL of an aqueous solution of sodium bromide (containing 0.17 g of sodium bromide) were simultaneously added to the reaction vessel over a period of 1 minute at a constant rate. The mixture was stirred for 1 minute, and the temperature of within the reaction vessel was raised to 60° C. over a period of 9 minutes. Then 88 mL of an aqueous gelatin solution (containing 16.7 g of alkali processed gelatin and 4.3 mL of 2.5 N sodium hydroxide) were added to the mixture over a period of 2 minutes. Thereafter 16.7 mL of an aqueous solution (containing 2.76 g of sodium bromide and 0.15 g of potassium iodide) were added to the mixture at a constant rate over a period of 2 minutes. Then 320 mL of an aqueous silver nitrate solution (containing 87.0 g of silver nitrate) and 309.5 mL of an aqueous halide solution (containing 53.3 g of sodium bromide and 2.98 g of potassium iodide) were simultaneously added to the mixture at a constant rate of acceleration starting from respective rates of 1.33 mL/min and 1.37 mL/min for the subsequent 60 minutes.

Thereafter 410.7 mL of an aqueous silver nitrate solution (containing 111.6 g of silver nitrate and 394.5 mL of an aqueous halide solution (containing 683 g of sodium bromide and 3.8 g of potassium iodide) were simultaneously added at a constant rate over a period of 44 minutes.

The overall average iodide content of the grains was 3.5 mole percent, based on total silver. The average ECD of the emulsion grains was 2.6 μm, the average grain thickness was 0.13 μm, the average aspect ratio of the tabular grains was 19 and their average tabularity was 143. The grains exhibited a COV of 26.3 percent.

The emulsion was sensitized, blended with coupler, coated, exposed to green light and processed identically as the emulsions previously described. Setting the relative green speed of Emulsion E-1 at 100 as described above, the relative speed of Emulsion C-7 was 46. The relatively lower sensitivity of Emulsion C-7 demonstrates the importance of the iodide profile requirements to produce higher emulsion sensitivity.

The following emulsion descriptions are provided to demonstrate that variations in average grain ECD, thickness, average aspect ratio and average tabularity can be readily achieved without otherwise satisfying the requirements of the invention.

Emulsion E-7 (EBR028)

This emulsion was prepared by the procedure described above form Emulsion E-1, except that a) the initial gel concentration in the reaction vessel was increased by factor of two (i.e., doubled) and b) the quantities of silver solution and bromide solution added during nucleation were doubled.

This had the effect of increasing the number of grain nuclei formed, increasing the number of grains competing for silver halide during growth, and consequently reducing the average ECD of the emulsion. The iodide profiles of the tabular grains remained within invention requirements. A summary of grain characteristics is provided below in Table II.

Emulsion E-8 (EBR029)

This emulsion was prepared by the same procedure as Emulsion E-7, except that following adjustment of pH to 5.85, only the silver nitrate solution was run into the reaction vessel until the pBr was increased to 2.1. At that point the aqueous bromide solution was introduced, and pBr was held constant for the remainder of the precipitation.

The purpose of increasing the pBr during the precipitation was to increase the average thickness of tabular grains. A summary of grain characteristics is provided below in Table II.

Emulsion E-9 (EBR034)

This emulsion was prepared by the same procedure as Emulsion E-7, except that following adjustment of pH to 5.85, only the silver nitrate solution was run into the reaction vessel until the pBr was increased to 2.7. At that point the aqueous bromide solution was introduced, and pBr was held constant for the remainder of the precipitation.

The purpose of increasing the pBr during the precipitation was to increase the average thickness of tabular grains. A summary of grain characteristics is provided below in Table II.

TABLE II

| Emul. | ECD (μm) | t (μm) | ECD / t | ECD / $t^2$ | COV (%) |
|---|---|---|---|---|---|
| E-7 | 2.16 | 0.11 | 19 | 172 | 12.3 |
| E-8 | 1.75 | 0.16 | 11 | 69 | 9.7 |
| E-9 | 1.50 | 0.24 | 6 | 25 | 11.4 |

From Table II it is apparent that the process of the invention is capable of producing tabular grain emulsions of any selected average grain size, thickness, aspect ratio or tabularity.

The invention has been described in detail with particular reference to preferred embodiments thereof, but it will be understood that variations and modifications can be effected within the spirit and scope of the invention.

What is claimed is:

1. A process of preparing a silver iodobromide tabular grain emulsion of enhanced photographic sensitivity comprised of the steps of providing within a reaction vessel a population of silver bromide or iodobromide host grains exhibiting a coefficient of variation of less than 20 percent and containing less than 2 mole percent iodide, said host grains consisting essentially of tabular grains, while maintaining a pBr of at least 2.2 within the reaction vessel introducing iodide ions simultaneously with bromide and silver ion into the reaction vessel for deposition onto the major faces on the host tabular grains, with iodide ions accounting for at least 25 mole percent of total halide ions introduced, and limiting the overall iodide content of the emulsion to the range of from 2 to less than 10 mole percent, based on total silver.

2. A process according to claim 1 wherein the host tabular grain emulsion exhibits a coefficient of variation of less than 15 percent.

3. A process according to claim 2 wherein the host tabular grain emulsion exhibits a coefficient of variation of less than 10 percent.

4. A process according to claim 1 wherein the host tabular grain emulsion contains less than 1 mole percent iodide, based on silver.

5. A process according to claim 4 wherein the host tabular grain emulsion consists essentially of silver bromide.

6. A process according to claim 1 wherein the host tabular grain emulsion accounts for greater than 50 percent of the total silver present in the completed emulsion.

7. A process according to claim 1 wherein, subsequent to depositing silver, bromide and iodide ions onto the host tabular grains, silver and bromide ions are deposited, with the amount of silver introduced during this step ranging from 5 to 30 percent of the total silver in the completed emulsion.

8. A process according to claim 1 wherein the overall iodide content of the emulsion is limited to less than 7 mole percent, based on total silver.

9. A process according to claim 1 wherein the step of introducing silver, bromide and iodide ions for deposition onto the major faces of the host tabular grains is conducted with iodide ions accounting for up to 40 mole percent of total halide ions introduced and while maintaining within the reaction vessel a pBr of at least 2.2.

10. A silver iodobromide emulsion of enhanced photographic sensitivity comprised of a dispersing medium and silver iodobromide grains WHEREIN the silver iodobromide grains contain from 2 to less than 10 mole percent iodide based on total silver, exhibit a coefficient of variation of less than 20 percent, and consist essentially of tabular grains having opposed parallel major faces and each of the tabular silver iodobromide grains within a central projected area extending half the distance to its peripheral edge exhibit an iodide concentration in excess of 6 mole percent within a surface region extending to a depth of 0.02 $\mu$m and exhibit an iodide concentration measured in a thickness bisecting plane oriented parallel to the opposed major faces of less than one third the iodide concentration of the surface region and less than 2 mole percent.

11. A silver iodobromide emulsion according to claim 10 wherein the silver iodobromide grains exhibit a coefficient of variation of less than 15 percent.

12. A silver iodobromide emulsion according to claim 11 wherein the silver iodobromide grains exhibit a coefficient of variation of less than 10 percent.

13. A silver iodobromide emulsion according to claim 10 wherein the silver iodobromide grains contain from 3 to 7 mole percent iodide, based on silver.

* * * * *